US008277541B2

(12) United States Patent
Hunt et al.

(10) Patent No.: US 8,277,541 B2
(45) Date of Patent: Oct. 2, 2012

(54) APPARATUS AND METHOD FOR SMOKE REMOVAL

(75) Inventors: Brian Hunt, Portsmouth (GB); Peter Row, Portsmouth (GB); Alex Wheatley, Portsmouth (GB)

(73) Assignee: Atmosphere Control International Limited, Portsmouth, Hampshire (GB)

( * ) Notice: Subject to any disclaimer, the term of this patent is extended or adjusted under 35 U.S.C. 154(b) by 778 days.

(21) Appl. No.: 12/295,485

(22) PCT Filed: Mar. 22, 2007

(86) PCT No.: PCT/GB2007/001027

§ 371 (c)(1),
(2), (4) Date: Jun. 5, 2009

(87) PCT Pub. No.: WO2007/113472

PCT Pub. Date: Oct. 11, 2007

(65) Prior Publication Data

US 2009/0241776 A1 Oct. 1, 2009

(30) Foreign Application Priority Data

Mar. 31, 2006 (GB) ..... 0606571.8

(51) Int. Cl.
*B03C 3/36* (2006.01)

(52) U.S. Cl. ..... 95/63; 95/69; 95/70; 95/78; 96/39; 96/55; 96/57; 96/63

(58) Field of Classification Search ..... 96/39, 41, 96/55, 57, 58, 62, 63, 68, 86, 87, 94, 96; 55/385.8; 95/63, 69, 70, 78
See application file for complete search history.

(56) References Cited

U.S. PATENT DOCUMENTS

| | | | | | |
|---|---|---|---|---|---|
| 2,397,197 | A | * | 3/1946 | Newman | 96/58 |
| 4,433,985 | A | | 2/1984 | McGee | |
| 4,446,109 | A | * | 5/1984 | Bakke | 422/168 |
| 4,902,316 | A | * | 2/1990 | Giles et al. | 96/58 |
| 5,230,720 | A | | 7/1993 | Kendall | |
| 5,779,769 | A | * | 7/1998 | Jiang | 96/55 |
| 5,904,755 | A | * | 5/1999 | Kanazashi et al. | 96/55 |
| 5,958,112 | A | * | 9/1999 | Nojima | 96/55 |
| 5,992,412 | A | | 11/1999 | Paulger | |
| 6,156,088 | A | * | 12/2000 | Cardarelli | 55/385.8 |

(Continued)

FOREIGN PATENT DOCUMENTS

EP 0 831 279 A1 3/1998

(Continued)

OTHER PUBLICATIONS

Foreign document denoted.*

(Continued)

*Primary Examiner* — Richard L Chiesa
(74) *Attorney, Agent, or Firm* — Smith, Gambrell & Russell, LLP

(57) ABSTRACT

A smoke removal apparatus, capable of operating in a confined space without ventilation of the apparatus to the atmosphere to provide removal of smoke from air to be treated. The apparatus includes one or more of the following filters: a mechanical filter; an electrostatic filter; and/or a chemical filter. The apparatus is arranged to collect smoke from a relatively higher position, pass smoke through the one or more filters/and expel treated air to a relatively lower position.

41 Claims, 3 Drawing Sheets

U.S. PATENT DOCUMENTS

| | | | | |
|---|---|---|---|---|
| 6,235,090 | B1 * | 5/2001 | Bernstein et al. | 96/57 |
| 6,471,754 | B2 * | 10/2002 | Ammouri | 96/58 |
| 7,811,348 | B2 * | 10/2010 | Paterson et al. | 55/413 |
| 2004/0118276 | A1 * | 6/2004 | Kim | 95/8 |
| 2004/0118285 | A1 * | 6/2004 | Kim et al. | 96/55 |
| 2006/0162564 | A1 * | 7/2006 | Paterson et al. | 96/55 |

FOREIGN PATENT DOCUMENTS

| | | | |
|---|---|---|---|
| EP | 1 058 066 | A2 | 12/2000 |
| EP | 1481717 | A1 * | 12/2004 |
| JP | 4356644 | | 12/1992 |
| WO | WO 99/15837 | | 4/1999 |
| WO | WO 00/21645 | | 4/2000 |

OTHER PUBLICATIONS

International Search Report issued in corresponding International Application No. PCT/GB2007/001027, dated Jun. 28, 2007.

Combined Search and Examination Report issued in corresponding Great Britain Application No. GB0606571.8, dated Jul. 13, 2006.

* cited by examiner

FIG. 3
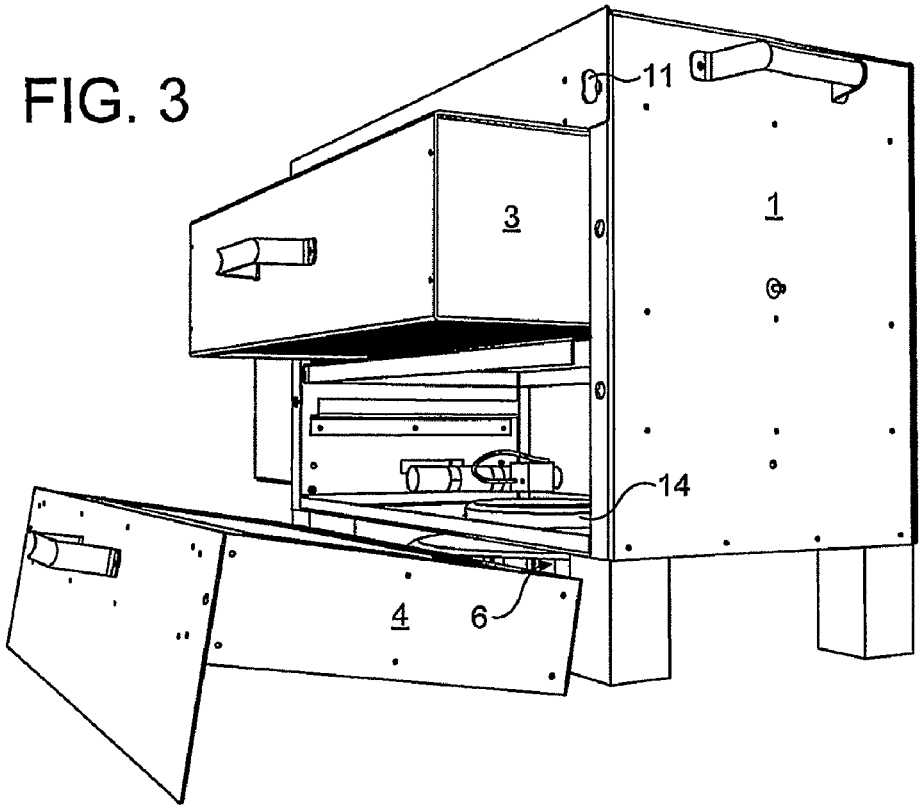
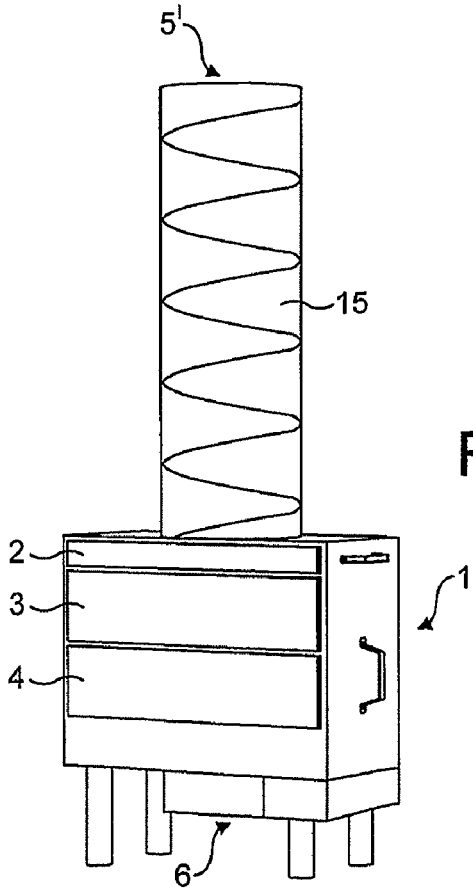
FIG. 4

APPARATUS AND METHOD FOR SMOKE REMOVAL

This invention relates to smoke removal apparatus and an associated method for smoke removal. In particular, the invention concerns the removal of smoke from a confined space without the necessity of ventilating the confined space to the atmosphere.

Smoke is a visible suspension of gases and particles in air produced through combustion of a material, as a result of a fire, for example. It is well-known that inhalation of smoke is dangerous to humans and can cause serious respiratory trouble, leading to death in some cases. The cause of death can be thermal damage, poisoning and/or pulmonary irritation. Both poisoning and pulmonary irritation are often caused by toxins present in smoke. Generally speaking, a person subjected to smoke inhalation for a longer period will be more likely to be seriously injured. Further, smoke is still very dangerous long after a fire has been extinguished, especially in confined spaces. Smoke can make seeing difficult and, when thick, obscures a person's view completely. This can lead to disorientation and increased danger. It is known that smoke forms layers such that thicker smoke tends to be located higher in a room and that the layers of smoke decrease in thickness towards lower parts of the room. Typically, thicker smoke will be more visibility-reducing than less-thick smoke.

Although with the use of respiratory apparatus a person can breath in a smoke filled space, thick smoke will likely prevent the person from carrying out anything but simple tasks. Therefore, there is usually some delay before the clean up operation can start, following extinguishing of the fire, as the smoke must clear somewhat beforehand. Further, rescuers, for example firemen, may be unaware of the existence of a casualty in the smoke-filled space, as the casualty cannot be located by sight. It is, therefore, clear that it is beneficial in those circumstances for a room to be cleared of at least visibility-reducing smoke quickly.

Unfortunately, following a fire in a confined space having no means of direct ventilation with the atmosphere (outside air), it can be very difficult to remove the smoke. Such a situation arises in marine vessels, for example ships and submarines, and in buildings where any form of ventilation to the atmosphere would involve venting the confined space through other parts of the marine vessel or building. In the situation of a submarine, this is further complicated by the lack of openable hatches and, additionally, these hatches often cannot be opened as they are underwater.

At present, the only solution for removing smoke from a confined space (having no means of direct ventilation to the atmosphere) is to vent through other parts of the marine vessel or building either by simply opening doors or hatches, or by using lengthy pipe work and an extractor-fan arrangement. This can effect the breathable environment throughout the rest of the building or marine vessel, which is particularly disadvantageous. Further, arranging lengthy pipe work is very time consuming and increases the risk to humans from smoke, as the exposure time is longer.

Smoke removal units and domestic air treatment units are known in the art to provide treated air.

Smoke removal units have been devised for use in smoking rooms, for example. The units are permanently located in the smoking room in the region of the ceiling, typically. Smoke from cigarettes is drawn into the unit and subjected to mechanical and/or electrostatic filtration, as can be seen in the smoke removal units described in EP1481717-A. These units are only intended to deal with cigarette smoke which contains very low, if any, amounts of large particles or floating debris. Owing to their position around the ceiling, it is very unlikely that large particles or floating debris—for example soot or non-fully combusted material—of the kind emitted by a full-scale fire will reach the smoke removal unit on the ceiling, as a cigarette does not provide enough up-thrust to propel the large particles or floating debris that far. Further, although the units are intended for removing smoke from a room, the amount of smoke in the room would not be such that vision of a person would be substantially or totally obscured, in that, thick layers of visibility-reducing smoke do not typically occur. As such, smoke removal units, as described above, would neither cope with smoke from a fire nor are they intended to.

Domestic air treatment units are, typically, floor-mounted and intended to treat air to remove dust, smells and/or biological material to aid sufferers of asthma or other respiratory illnesses. To do that, mechanical and/or electrostatic filters may be used to filter air and any suspended contaminants. However, these units are not intended to deal with actual smoke of any kind, although, they may tackle the issue of the smell of smoke from cigarettes, for example. As such, these units would neither cope with smoke from a fire nor are they intended to.

Further, particles of a larger size or floating debris are likely to clog domestic air treatment units and smoke removal units as the filters provide a very high degree of filtering for small particles and are, therefore, prone to clogging if particles—for example floating debris—of a much larger size than intended for that machine become entrained in the filters.

In addition, both domestic air treatment units and smoke removal units provide removal of smoke or treatment of air at temperatures of the smoke or air that are substantially at room temperature. The filters, in particular the mechanical filters, are simply not designed to deal with smoke from a fire that may have a very high temperature when entering the unit, as aspects of the filters may melt.

It will also be understood that smoke from a fire that has just recently been extinguished may contain a large amount of water and/or water vapour. The water-vapour content of the smoke will be much higher than that of air at room temperature. Again, neither the smoke removal units nor the domestic air treatment units are designed to deal with high amounts of water and/or water vapour.

Therefore, there is a need for an apparatus and method which provide an improved way of removing smoke from a confined space, having no means of direct ventilation to the atmosphere. In particular, there is a need for an apparatus that substantially removes smoke from a confined space quickly.

Accordingly, in a first aspect, the present invention provides a smoke removal apparatus, capable of operating in a confined space without ventilation of the apparatus to the atmosphere to provide removal of smoke from air to be treated, comprising one or more of the following filters:

a mechanical filter;

an electrostatic filter; and/or a chemical filter;

wherein the apparatus is arranged to collect smoke from a relatively higher position, pass smoke through the one or more filters, and expel treated air to a relatively lower position.

Preferably, the apparatus is arranged to collect smoke to a substantially upper-region of the apparatus.

Further preferably, the apparatus is arranged to collect smoke from substantially above the apparatus.

Preferably, the apparatus is arranged to expel treated air from a substantially lower-region of the apparatus.

Further preferably, the apparatus is arranged to expel treated air to substantially below the apparatus.

Advantageously, the apparatus may be provided with an outlet arranged to expel treated air in a direction substantially perpendicular to smoke passing through the one or more filters.

Advantageously, the apparatus may be provided with an outlet arranged to provide radial distribution of treated air.

As a preference, smoke may be passed substantially downwardly through the one or more filters.

The smoke removal apparatus may further comprise fan means, arranged to collect smoke, pass it through the one or more filters and expel treated air from the apparatus. In particular, the fan means may comprise part of the outlet and, preferably, the fan means may comprise a centrifugal fan having a rotating outlet, which provides radial distribution of treated air.

Preferably, the apparatus comprises an inlet, located at a substantially upper-region of the apparatus and may further comprise an inlet flue operatively connected to the inlet that is suitable for providing a relatively higher inlet to the apparatus. Preferably, the inlet flue may be extendable to vary the height of the inlet.

The filters may be arranged in compartments, each compartment individually arranged to be easily removed for cleaning or replacement.

Preferably, the mechanical filter comprises a coarse mesh. The mesh may be made of a material comprising aluminium.

The electrostatic filter may comprise an arrangement of an ionising wire and alternatively charged plates.

The chemical filter may comprise activated carbon. Preferably, the chemical filter may further comprise alkali salts or acid salts, for neutralisation of acidic or basic gaseous molecules. As such, the alkali salts may comprise soda lime.

Preferably, the smoke removal apparatus is provided as a single unit.

Further preferably, the smoke removal apparatus is arranged to be floor-mounted.

Most preferably, the smoke removal apparatus is arranged to be portable.

In particular, the apparatus is arranged to treat air which is polluted by smoke. As a consequence of the smoke, visibility through the air to be treated has been reduced and, following treatment, visibility through the treated air is improved.

Advantageously, the apparatus is arranged to be used in a room in a building or in a compartment onboard a marine vessel.

Most preferably, the apparatus further comprises a portable power source.

In a second aspect, the invention provides a method of smoke removal comprising: providing a smoke removal apparatus, capable of operating in a confined space without ventilation of the apparatus to the atmosphere to provide removal of smoke from air to be treated, comprising one or more filters selected from a mechanical filter; an electrostatic filter; and/or a chemical filter; wherein smoke is collected from a relatively higher position, is passed through the one or more filters and treated air is expelled to a relatively lower position.

Preferably, smoke is collected to a substantially upper-region of the apparatus.

Most preferably, smoke is collected from substantially above the apparatus.

Preferably, treated air is expelled from a substantially lower-region of the apparatus.

Most preferably, treated air is expelled to substantially below the apparatus.

The apparatus may be provided with an outlet which expels treated air in a direction substantially perpendicular to smoke passing through the one or more filters.

Preferably, the apparatus is provided with an outlet at a substantially lower-region of the apparatus which, preferably, provides radial distribution of treated air.

In particular, smoke may be passed substantially downwardly through the one or more filters from the substantially upper-region of the apparatus to the substantially lower-region of the apparatus.

Preferably, smoke may be collected and passed through the one or more filters, and treated air may be expelled by way of fan means.

Most preferably, smoke may be subjected to particulate filtration, then electrostatic filtration, then chemical filtration.

Advantageously, during periods of inactivity of the apparatus, the filters may be each individually easily removed for cleaning or replacement.

Preferably, the smoke removal apparatus may be portable and may be transported to a site in need of smoke removal, and operated to provide treated air.

Most preferably, the smoke removal apparatus may be operated to treat air which is polluted by smoke to substantially remove smoke therefrom. As such, when smoke has reduced visibility, the apparatus may be operated to treat the smoke and provide improved visibility.

Advantageously, the present invention provides for removal of smoke from a confined space. Most advantageously, the present invention provides clearance of visibility-reducing smoke from a space, whether the space be confined or not. Further, clearance is carried out quickly, so as to remove visibility-reducing smoke from a room or compartment in a matter of minutes, which allows removal of casualties for further clear-up operations to begin quicker than if the room or compartment was left to clear naturally. Further, the apparatus may be used advantageously to aid clearance of smoke from a room which does have some form of ventilation to the atmosphere.

Advantageously, positioning of the outlet at the bottom of the apparatus provides a layer of treated air beneath the smoke, such that treated air is not directly mixed with smoke.

Further advantageously, providing the treated air radially from the outlet and, therefore, providing a layer of treated air at or around ground level or at least below the smoke, mixing of treated air and smoke is minimised. As a consequence of minimising mixing, visibility in the room or compartment is restored more quickly. Therefore, turbulence between smoke and treated air is minimised and a near homogenous layer of treated air is provided below the layers of smoke.

Further advantageously, a room or compartment is cleared of smoke by providing layers of treated air beneath the smoke which push upwards on the smoke which, at least partly, pushes the smoke towards the inlet of the apparatus and/or towards upper parts of the room or compartment, from where it may be collected for filtering.

Embodiments of the invention shall now be described by way of example only, with reference to, or as shown in the accompanying drawings, in which:

FIG. 3 is view of the front and one side of the smoke removal apparatus of FIG. 1, showing one of the filter compartments removed;

FIG. 4 is a perspective view of the smoke removal apparatus of FIG. 1, showing an attached inlet flue;

Figure 1:
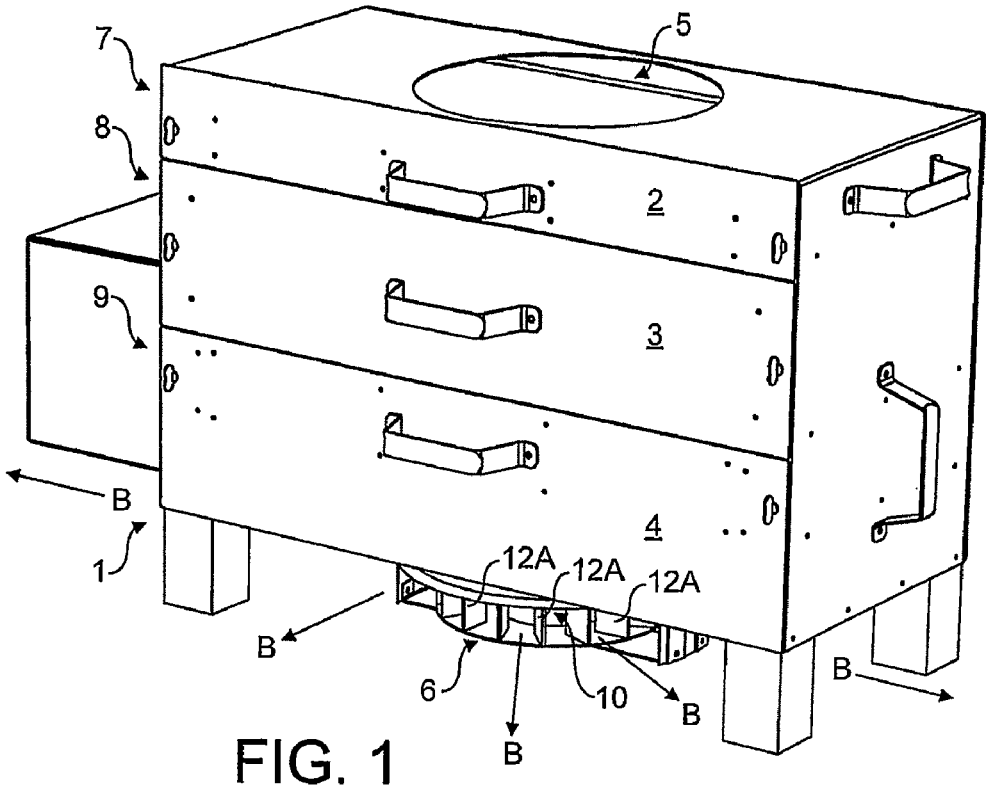
FIG. 1 is a perspective view of the smoke removal apparatus of the present invention, shown from the front.
Figure 2:
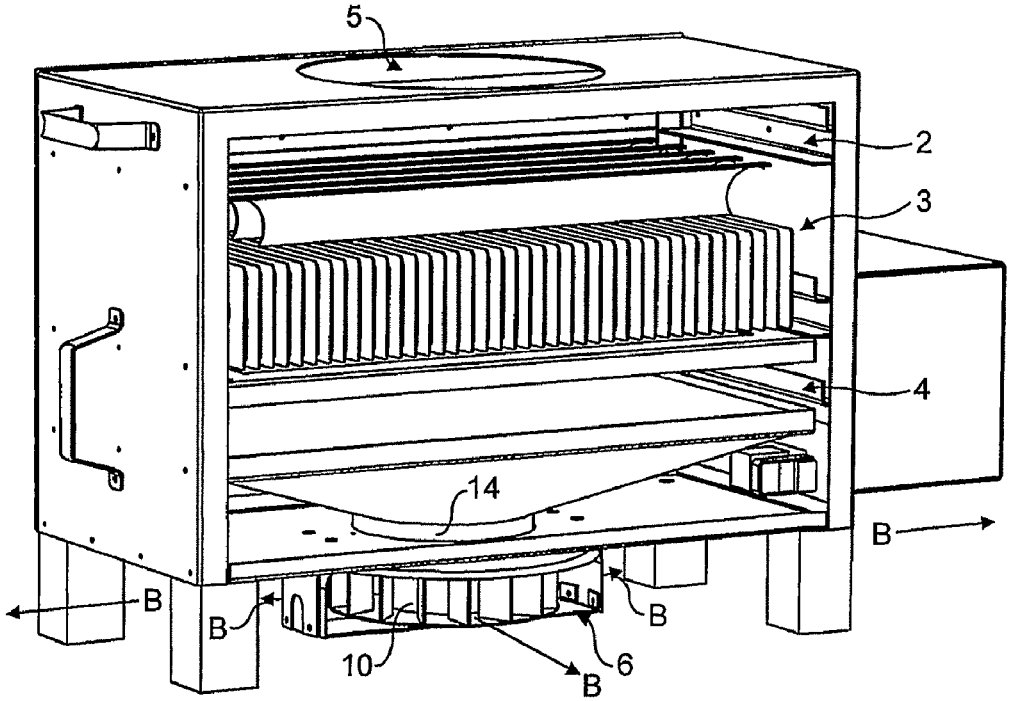
FIG. 2 is a perspective view of the rear of the smoke removal apparatus of FIG. 1, having the back removed.

As shown in FIGS. 1 to 3, the smoke removal apparatus of the present invention is shown, in general, by reference 1. The apparatus 1 is provided with three filters in the forms of a mechanical filter 2, an electrostatic filter 3, and a chemical filter 4. The filters 2,3,4 are provided in individual compartments and are each removable from the apparatus 1, by sliding them in or out in a draw-like manner, for cleaning or replacement thereof. Further, the apparatus is provided with an inlet 5 and an outlet 6 for smoke to enter or exit the apparatus 1. In the context of the specific description, smoke is the air to be treated by the apparatus 1.

The apparatus 1 is capable of operating in a confined space without ventilation of the apparatus to the atmosphere. The confined space may be any room in a building or compartment onboard a marine vessel which contains smoke.

The mechanical filter 2 is provided in a compartment towards the top 7 of the apparatus 1 and has an aluminium mesh filter consisting of several layers of corrugated, aluminium mesh. The mechanical filter provides initial filtration of larger particles, say, particles having a second dimension greater than 1 mm. As such, it will be understood that such a mechanical filter is a coarse filter intended to filter relatively larger particles, in particular, floating debris and fly ash. It is preferred to filter these relatively larger particles as they may cause arcing of electricity when entering the electrostatic filter, which can disrupt the filtering achieved by that filter. This filter is arranged to provide quick filtering of smoke to remove a substantial amount of large particles and/or floating debris from the smoke prior to the smoke passing through to the electrostatic filter. The nature of the mechanical filter—the aluminium mesh—is such that it can be easily removed from the apparatus 1 and cleaned to remove entrained particles. Therefore, the mechanical filter 2 is re-usable. Naturally, the filter may be made of other suitable material, for example, other metals or any material capable of filtering the hot smoke without deforming or decomposing.

The electrostatic filter 3 is provided in a further compartment located towards the middle 8 of the apparatus 1 and operates in a standard manner. It consists of an earthed casing—that may be part of the compartment—which holds a number of plates that alternate between 0V (Volts)—earth—and around 4.8 kV along the length. There is a rail at the top of the filter holding ionising wires. These wires are charged at around 8 kV. A substantial part of the smoke passing past these wires becomes charged and then sticks to the alternating plates, removing those particles from the smoke. The remaining smoke is then transferred to the chemical filter. The power for the electrostatic filter 3 is provided by a drive unit which is included in the body of the apparatus 1. This filter 3 is removable from the apparatus, cleanable and re-usable. Advantageously, arcing of smoke on the plates and/or wires can be minimised by using a lower voltage on the plates and wires.

The chemical filter 4 consists of a compartment having a metal meshed top and bottom located towards the bottom 9 of the apparatus 1. The filter 4 includes one or more layers of activated carbon, in the form of carbon cloth, and an amount of soda lime, which is provided in dry-state, for example, granules. Preferably, the carbon cloth and soda lime are separated by a metal mesh. The carbon cloth and soda lime absorb part of the smoke left over from mechanical and electrostatic filtration and substantially remove—or at least substantially reduce—from the air, for example, any remaining toxic gases. The chemical filter may be used a number of times but is not infinitely re-usable, as its operation is dependent upon the lifetime of effective operation of the soda lime and carbon—which cannot be simply cleaned to prolong use and must be replaced The inlet 5 is provided at the top 7 of the apparatus 1, as can be seen in FIGS. 1 and 2. Advantageously, positioning the inlet 5 in this manner allows the apparatus 1 to initially draw air to be treated (smoke) from upper regions of a room or compartment—which is the likely location of the smoke. The drawn air is fed directly into the mechanical filter 2. In a further embodiment, as shown in FIG. 4 in particular, the apparatus 1 may be provided with an inlet flue 15 which is operatively connected to the inlet 5 of the apparatus 1, and provides an inlet to the apparatus 5' at the end of the inlet flue 15 remote from the apparatus 1. The inlet flue 15 may be extendable and can be used to draw smoke from higher areas of, say, a room or compartment, or, in general, draw smoke from a higher location. The inlet flue 15 may be extended manually or automatically. In a further embodiment, it may be self-propelled.

The outlet 6 is provided at the bottom 9 of the apparatus, as can be seen in FIGS. 1 and 2. The outlet 6 provides an outlet for treated air at or around ground level and, optionally, in all directions. In particular, treated air is provided radially from the outlet, that is to say, that treated air is expelled from the apparatus radially in all directions which are substantially horizontal to the ground and running parallel with the ground upon which the apparatus stands. As such, the radially-expelled treated air has undergone a 90° rotation in the outlet 6 from the substantially vertical direction of filtering from the top 7 of the apparatus to the bottom 9. This is exemplified by Arrows B in FIG. 5A, which show the movement of treated air in all directions radially from a circular fan arrangement 10. As such, a layer of treated air is provided at or around ground level or at least below the smoke. Advantageously, positioning of the outlet at the bottom 9 of the apparatus 1 provides a layer of treated air beneath the smoke, such that treated air is not directly mixed with smoke. Further advantageously, providing the treated air radially from the outlet and, therefore, providing a layer of treated air at or around ground level or at least below the smoke, mixing of treated air and smoke is minimised. As a consequence of minimising mixing, visibility in the room or compartment is restored more quickly.

Figure 5A:
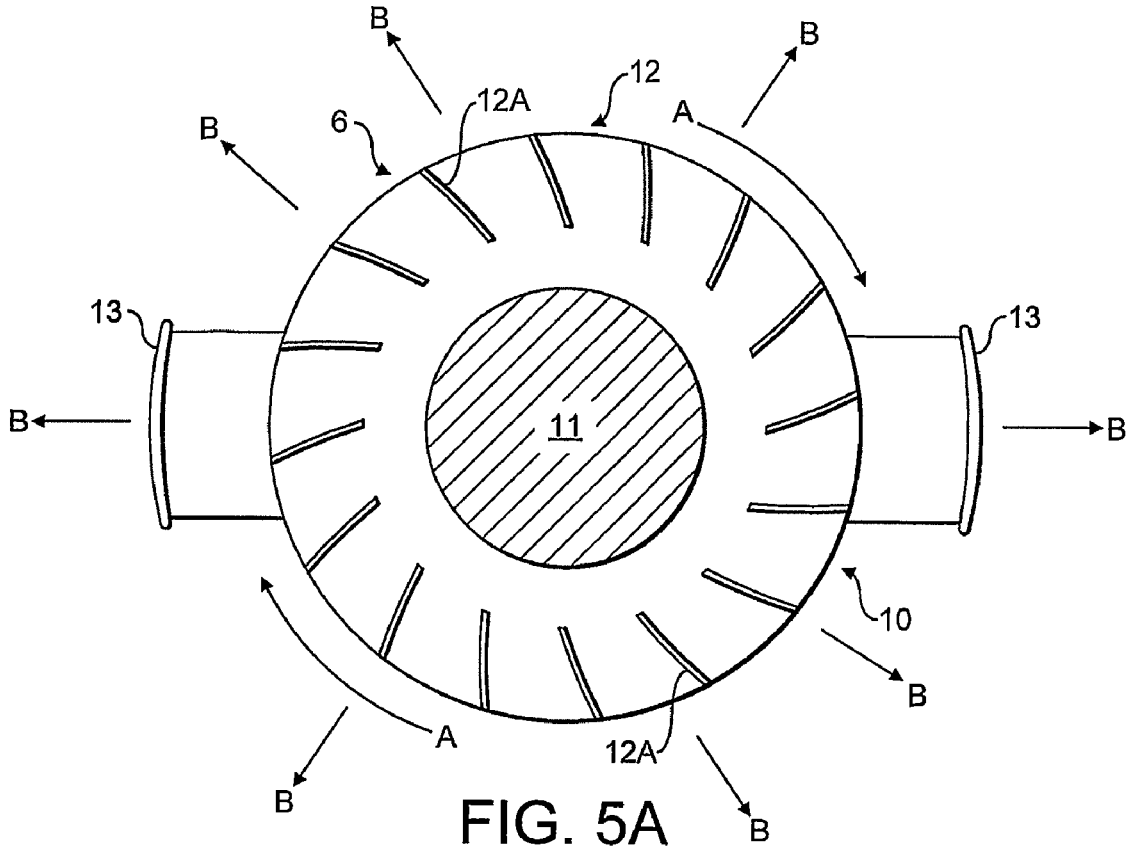
FIG. 5A is a plan view of the outlet of the smoke removal apparatus of FIG. 1.
Figure 5B:
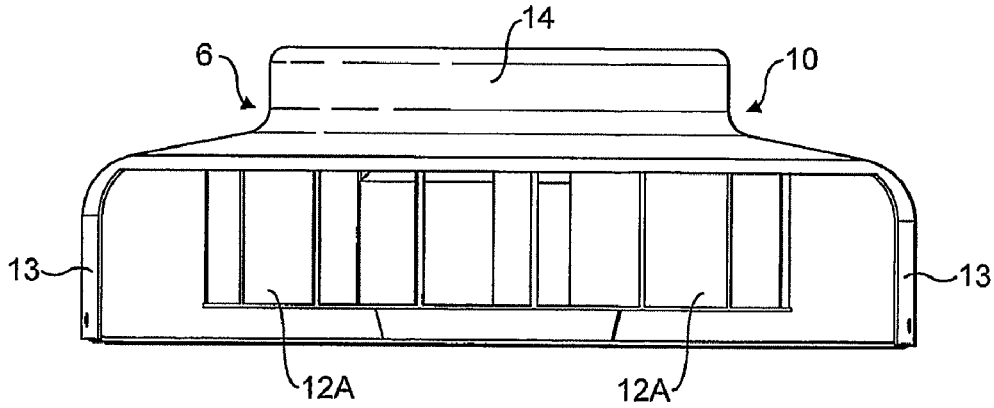
FIG. 5B is a side-view of the outlet of FIG. 5A.

A fan arrangement 10 is provided to draw smoke into the apparatus 1, pass the smoke through in turn each of the mechanical, electrostatic and chemical filters, and expel treated air from the apparatus 1. The fan arrangement 10 is located in the region of the outlet 6, at the bottom 9 of the apparatus. Smoke is filtered through the one or more filters 2,3,4 in a substantially downwards direction. By the phrase 'downward direction', it is meant that smoke is filtered when travelling from the top 7 of the apparatus 1 to the bottom 9 thereof. As can be seen in FIGS. 5A and 5B, the fan arrangement 10 is integral with the outlet 6. The integral fan arrangement 10 and outlet 6 is provided with a circular, centrifugal fan 12 having a number of fins 12A for directing treated air radially from the apparatus and approximately parallel to the ground. A motor 11 is provided to drive the centrifugal fan 12. Further, the fan is located in a casing 13, which may prevent objects from being inadvertently introduced to the fan 12, and which casing provides support for the fan 12, but does not restrict radial distribution of treated air. Additionally, the casing is shaped to provide an inlet 14 which sucks treated air from the chemical filter 4. As mentioned herein, the fan arrangement is provided to draw smoke into the apparatus 1 and pass the smoke through the mechanical filter 2, the electrostatic filter 3 and the chemical filter 4 and then expel treated air from the apparatus 1. In order to provide fast collection and filtering of smoke, the apparatus is arranged to be capable of filtering flow rates of smoke up to around 800 cubic meters per hour. As such, pressure drop across each of the filters 2,3,4 is minimised to maintain high flow rates of smoke through the apparatus 1.

The apparatus 1 is also provided with appropriate circuitry and, at least, a processor (including a memory) to provide control and operation of the apparatus 1.

The apparatus 1 is provided with a power source (not shown) that is separate from the apparatus 1, in the form of a power pack. However, the apparatus can also run directly from mains electricity (or equivalent) or be powered by an internal battery.

Preferably, the whole apparatus 1 is capable of resisting a certain amount of heat. As such, the outer regions of the apparatus are made of metal and some internal components may be insulated. The main body of the apparatus is constructed nearly entirely of metal and is riveted together for strength, as the apparatus must be rugged and capable of being moved around. For example, the apparatus can be made nearly entirely of aluminium or steal.

FIG. 3 shows, in particular, the chemical filter 4 removed from the apparatus 1 and the electrostatic filter 3 partially removed from the apparatus 1. As can be seen in FIG. 3, the filters 2,3,4 are easily removed from the apparatus 1—in a draw-like manner—for cleaning or replacement. Further, the filters 2,3,4 can be secured in the apparatus by way of fixing means 11, in the form of screw fixers 11.

In use, the apparatus 1 is located in a room or compartment filled with smoke. The apparatus 1 may be permanently located in that room or compartment—if that room contains a potential hazard—or have been transported there in response to a fire. The apparatus 1 is primarily for use once the fire has been extinguished.

The apparatus 1 is operated to remove some or all smoke from the room or compartment and provide an atmosphere in the room or compartment of an acceptable level for further small scale cleanup to begin. This may involve ventilating the room or compartment to the surrounding area—not being the atmosphere—or to the atmosphere per se. In order to clarify use of the term the 'atmosphere', this should be understood to mean outside air, for example, opening a window is ventilating a room to the atmosphere.

In operation, smoke from upper regions of the room or compartment is drawn into the apparatus in the region of the top 7, through the inlet 5,5', by the fan arrangement 10. From the inlet 5,5', smoke is passed through the mechanical filter 2 to remove larger particles from the smoke and floating fire debris, for example, soot. The larger particles and/or floating debris are entrained in the aluminium mesh, which provides removal of them from the smoke. Smoke from the mechanical filter 2 is passed through the electrostatic filter 3 to remove further smoke particles and leave, substantially, only fire gas plus, perhaps, some very small particles. As such, smoke entering the electrostatic filter is substantially ionised such that a large proportion of the smoke sticks to the alternatively charged plates. The fire gas leaving the electrostatic filter 2 is finally filtered through the chemical filter where parts of the fire gas are absorbed by the carbon or soda lime, providing treated air, which has most constituents of smoke removed therefrom. Treated air is then returned to the room or compartment at around floor-level, providing a layer of treated air beneath the smoke. Preferably, as little mixing as possible of treated air and smoke occurs. As smoke exists in layers, it will be understood that a layer of treated air is provided in lower parts of a room or compartment. As the apparatus is operated, the size of the layer of treated air increases from lower parts of the room or compartment towards the upper parts of the room or compartment, and pushes upwards on the layers of smoke above. Consequently, by collecting smoke from substantially above the apparatus and by providing a constant stream of treated air during operation at around floor level (or below the apparatus), a form of convection current is provided which is intended to allow the apparatus to filter all of the smoke in the room or compartment.

The invention claimed is:

1. A smoke removal apparatus, for the removal of smoke from air to be treated in a confined space and capable of operating in the confined space without ventilation of the apparatus to the atmosphere, comprising one or more of the following filters:

a mechanical filter;

an electrostatic filter; and a chemical filter;

wherein the apparatus is arranged to collect smoke from a relatively higher position, pass smoke through the one or more filters, and expel treated air to a relatively lower position, and the apparatus is provided with an outlet arranged in a substantially lower region of said apparatus to achieve radial distribution of treated air so as to provide a layer of treated air beneath the smoke, and substantially horizontal to the ground, to clear the space of smoke, said apparatus further comprising a centrifugal fan positioned at said outlet, said fan having a plurality of fins for achieving said radial distribution of said treated air.

2. A smoke removal apparatus as claimed in claim 1, wherein the apparatus is arranged to collect smoke to a substantially upper-region of the apparatus.

3. A smoke removal apparatus as claimed in claim 1, wherein the apparatus is arranged to collect smoke from substantially above the apparatus.

4. A smoke removal apparatus as claimed in claim 1, wherein the apparatus further comprises a fan casing positioned adjacent to at least a portion of the centrifugal fan.

5. A smoke removal apparatus as claimed in claim 1, wherein the apparatus is arranged to expel treated air to substantially below the apparatus.

6. A smoke removal apparatus as claimed in claim 1, wherein the outlet is arranged to expel treated air in a direction substantially perpendicular to smoke passing through the one or more filters.

7. A smoke removal apparatus as claimed in claim 1, wherein smoke is passed substantially downwardly through the one or more filters.

8. A smoke removal apparatus as claimed in claim 1, wherein the centrifugal fan is a component of a fan means, arranged to collect air to be treated into the apparatus, pass the air to be treated through the one or more filters of the apparatus, and expel treated air from the apparatus.

9. A smoke removal apparatus as claimed in any claim 8, wherein the fan means further comprises a fan casing.

10. A smoke removal apparatus as claimed in claim 8, wherein the centrifugal fan comprises at least one rotating outlet, which provides radial distribution of treated air.

11. A smoke removal apparatus as claimed in claim 1, comprising an inlet, located at a substantially upper-region of the apparatus, further comprising an inlet flue operatively connected to the inlet and suitable for providing a relatively higher inlet to the apparatus.

12. A smoke removal apparatus as claimed in claim 11, wherein the inlet flue is extendable to vary the height of the inlet.

13. A smoke removal apparatus as claimed in claim 1, wherein the one or more filters are arranged in one or more respective compartments, each compartment individually arranged to be removable for cleaning or replacement.

14. A smoke removal apparatus as claimed in claim 1, comprising the mechanical filter, wherein the mechanical filter comprises a coarse mesh.

15. A smoke removal apparatus as claimed in claim 14, wherein the mesh is made of a material comprising aluminium.

16. A smoke removal apparatus as claimed in claim 1, comprising the electrostatic filter, wherein the electrostatic filter comprises an arrangement of an ionising wire and alternatively charged plates.

17. A smoke removal apparatus as claimed in any claim 1, comprising the chemical filter, wherein the chemical filter comprises activated carbon.

18. A smoke removal apparatus as claimed in claim 17, wherein the chemical filter further comprises alkali salts or acid salts, for neutralisation of acidic or basic gaseous molecules.

19. A smoke removal apparatus as claimed in claim 18, wherein the alkali salts comprise soda lime.

20. A smoke removal apparatus as claimed in claim 1, wherein the smoke removal apparatus is provided as a single unit.

21. A smoke removal apparatus as claimed in claim 1, wherein the smoke removal apparatus is arranged to be floor-mounted.

22. A smoke removal apparatus as claimed in claim 1, wherein the smoke removal apparatus is portable.

23. A smoke removal apparatus as claimed in claim 1, wherein the apparatus is arranged to treat air which is polluted by smoke.

24. A smoke removal apparatus as claimed in claim 23, wherein the smoke to be removed reduces visibility through the air to be treated and, following treatment, visibility through the treated air is improved.

25. A smoke removal apparatus as claimed in claim 1, wherein the apparatus is arranged to be used in a room in a building or in a compartment onboard a marine vessel.

26. A smoke removal apparatus as claimed in claim 1, wherein the apparatus further comprises a portable power source.

27. A smoke removal apparatus as claimed in claim 1, wherein the smoke removal apparatus is arranged to treat air which is polluted by smoke to substantially remove smoke therefrom.

28. A smoke removal apparatus as claimed in claim 1, wherein the smoke removal apparatus comprises a sequenced arrangement of a mechanical filter, an electrostatic filter and a chemical filter arranged to subject air to be treated to particulate filtration, then to an electrostatic filtration and then to a chemical filtration.

29. A method of smoke removal comprising, providing a smoke removal apparatus, capable of removing smoke from air to be treated in a confined space, and capable of operating in the confined space without ventilation of the apparatus to the atmosphere, comprising one or more filters selected from a mechanical filter; an electrostatic filter; and a chemical filter, and collecting smoke from a relatively higher position, passing smoke through the one or more filters, and expelling treated air to a relatively lower position, through an outlet arranged in a substantially lower-region of the apparatus, wherein the air is expelled so as to result in a radial distribution of treated air providing a layer of treated air beneath the smoke, and substantially horizontal to the ground, to clear the space of smoke, said apparatus comprising a centrifugal fan positioned at said outlet, said fan having a plurality of fins for achieving said radial distribution of said treated air.

30. A method of smoke removal as claimed in claim 29, wherein smoke is collected to a substantially upper-region of the apparatus.

31. A method of smoke removal as claimed in claim 29, wherein smoke is collected from substantially above the apparatus.

32. A method of smoke removal as claimed in claim 29, wherein a fan casing positioned adjacent to at least a portion of the centrifugal fan supports the fan and/or obstructs insertion of items into at least a portion of the fan.

33. A method of smoke removal as claimed in claim 29, wherein treated air is expelled to substantially below the apparatus.

34. A method of smoke removal as claimed in claim 29, wherein the apparatus is provided with an outlet which expels treated air in a direction substantially perpendicular to smoke passing through the one or more filters.

35. A method of smoke removal as claimed in claim 29, wherein air to be treated is passed substantially downwardly through the one or more filters from the substantially upper-region of the apparatus to the substantially lower-region of the apparatus.

36. A method of smoke removal as claimed in claim 29, wherein air to be treated is collected and passed through the one or more filters, and treated air is expelled by way of a fan means which comprises the centrifugal fan and a fan casing.

37. A method of smoke removal as claimed in claim 29, wherein air to be treated is subjected to particulate filtration, then electrostatic filtration, then chemical filtration.

38. A method of smoke removal as claimed in claim 29, wherein, during periods of inactivity of the apparatus, the one or more filters are each individually removed for cleaning or replacement.

39. A method of smoke removal as claimed in claim 29, wherein the smoke removal apparatus is portable and, in use, the apparatus is transported to a site in need of air purification, and operated to provide treated air.

40. A method of smoke removal as claimed in claim 29, wherein the smoke removal apparatus is operated to treat air which is polluted by smoke to substantially remove smoke therefrom.

41. A method of smoke removal as claimed in claim 29, wherein the smoke to be removed reduces visibility through the air to be treated and the apparatus is operated to provide improved visibility to the treated air.

* * * * *